United States Patent [19]

Denis

[11] 4,063,768

[45] Dec. 20, 1977

[54] HANGING FLOWER BASKET TOOL

[75] Inventor: Anna Denis, New York, N.Y.

[73] Assignee: The Raymond Lee Organization, Inc., New York, N.Y.

[21] Appl. No.: 708,906

[22] Filed: July 26, 1976

[51] Int. Cl.[2] ..... A47F 13/06; A47G 7/00

[52] U.S. Cl. ..... 294/19 R

[58] Field of Search ..... 294/1 R, 19 R, 20–22, 294/27 R, 29, 31.2, 86 R; 47/1 R, 39, 40, 41; 248/121, 125, 146, 149, 153, 161, 312, 315, 318, 156; D6/182, 183

[56] References Cited

U.S. PATENT DOCUMENTS

| | | | |
|---|---|---|---|
| 1,162,575 | 11/1915 | Craig | 248/153 |
| 1,406,893 | 2/1922 | Randall | 248/146 |
| 1,609,246 | 11/1926 | Hamburger | 47/39 |
| 1,763,130 | 6/1930 | Cartwright | 248/146 |
| 2,136,279 | 11/1938 | De Vilbiss | 248/153 |
| 2,312,521 | 3/1943 | Bull | 294/19 R |
| 2,495,315 | 1/1950 | Carr | 248/146 |
| 2,642,245 | 6/1953 | Rice et al. | 248/121 |

*Primary Examiner*—Johnny D. Cherry
*Attorney, Agent, or Firm*—Howard I. Podell

[57] ABSTRACT

A tool for lifting a suspended flower pot that fastens about the bottom and sides of a suspended flower pot so as to lift it on or off its suspended support. The tool is in the form of a pole fitted at its working end with a ring of the general outer diameter of a flower pot, with the ring joined by two L-shaped support rods which extend into an axial end hole in the pole.

1 Claim, 3 Drawing Figures

HANGING FLOWER BASKET TOOL

SUMMARY OF THE INVENTION

My invention is a tool for lifting a suspended flower pot that fastens about the bottom and sides of a suspended flower pot so as to lift it on or off its suspended support. The tool is in the form of a pole fitted at its working end with a ring of the general outer diameter of a flower pot, with the ring joined by two L-shaped support rods which extend into an axial end hole in the pole.

By means of my invention, a flower pot or basket may be lifted above the head of the person holding the tool to fasten to a hook, or readily removed from a hook, as desired.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
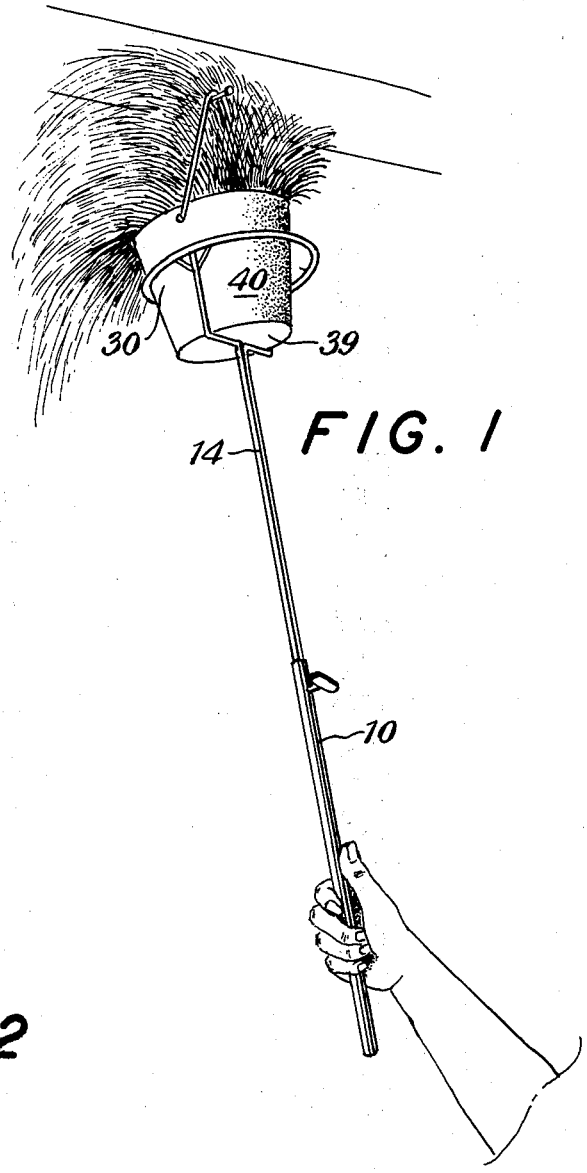
FIG. 1 is a perspective view of the invention is use.
Figure 2:
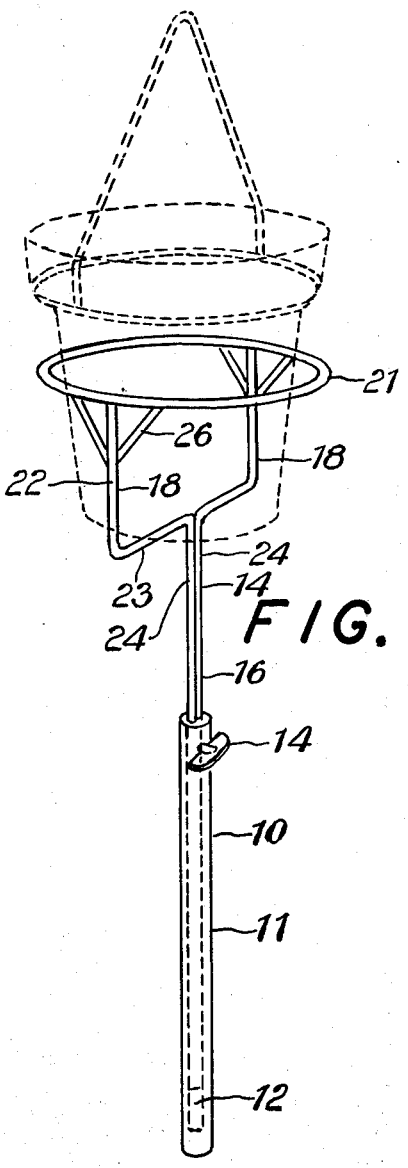
FIG. 2 is an elevation view of the invention.
Figure 3:
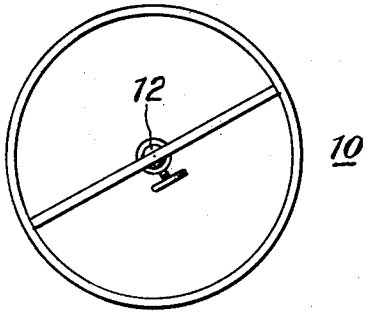
FIG. 3 is a plan view of the invention.

Turning now descriptively to the drawings, in which similar reference characters denote similar elements throughout the several views, FIGS. 1–3 illustrate the tool 10 formed of a hollow pole 11 with the jaw unit 14 slidably mounted in the axial hole 12 of pole 11 and fixed in position by thumbscrew 14 laterally threaded in the wall of pole 11 that bears against the shank section 16 of jaw unit 14.

Jaw unit 14 is formed of an open ring 21 mounted in a plane perpendicular to the axis of pole 11 and shank section 16, with ring 21 fitted on its perimeter to two L-shaped support rods 18. Each support rod 18 is formed of a first leg 22 fixed to ring 21 and extending generally perpendicular to the plane of the ring 21 towards and joining a second leg 23, that extends generally parallel to the plane of rim 21, towards and joining the third leg 24 that extends in the axial direction of shank 16 and pole 11 away from ring 21. The two legs 24 are joined together to form the shank section 16 of jaw unit 14. Brace members 26 may join the ring 21 with each first leg 22, and ring 21 is of a diameter to fit loosely about the mid-section 30 of a flower pot 40, with legs 22 of a length to enable legs 23 to rest against the bottom 39 of a pot, the mid-section 30 of which is encircled by ring 21.

Tool 10 may be formed of many combinations of different size jaw sections 14 to fit about pots of different sizes.

Legs 22 may extend in tapered fashion from the perimeter of a ring 21 to legs 23 which are shorter than the radius of ring 21 to fit about tapered pots.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tool for lifting a suspended flower pot onto or off a suspension support comprising a pole section, and a jaw section attached by a shank section of the jaw section to the pole section, said jaw section formed of an open ring member fixed to a pair of spaced opposed L-shaped leg members which are joined to the said shank section, in which the shank section of the jaw section fits within an axial hole of the pole section, together with adjustable clamping means to fix the shank section in position to the pole section, with each L-shaped leg member formed of a first leg section that extends from the attached ring member generally perpendicular to the plane of the ring member, and a second leg section that extends generally perpendicular to the first leg section and perpendicular to a shank member to which it is joined with both shank members joined along their length to form the said shank section and extending generally along an axis perpendicular to the center of the ring member, such that the bottom of a flower pot being lifted may rest on said second leg sections and against the ring member encircling the mid-section of said flower pot and with the shank section and pole section extending below the bottom of the lifted flower pot.

* * * * *